US005560439A

United States Patent [19]

Delwiche et al.

[11] Patent Number: 5,560,439

[45] Date of Patent: Oct. 1, 1996

[54] METHOD AND APPARATUS FOR REDUCING THE VIBRATION AND WHIRLING OF DRILL BITS AND THE BOTTOM HOLE ASSEMBLY IN DRILLING USED TO DRILL OIL AND GAS WELLS

[76] Inventors: Robert A. Delwiche, 201 Rue Victor Allard, B-1180 Brussels, Belgium; Hwa-Shan Ho, 5411 Mineral Creek Ct., Spring, Tex. 77379

[21] Appl. No.: 424,139

[22] Filed: Apr. 17, 1995

[51] Int. Cl.[6] ..... E21B 17/10

[52] U.S. Cl. ..... 175/325.1; 175/325.5; 175/408

[58] Field of Search ..... 175/325.1, 325.2, 175/325.5, 359, 408, 414

[56] References Cited

U.S. PATENT DOCUMENTS

| | | | |
|---|---|---|---|
| 4,862,974 | 9/1989 | Warren et al. | 175/325.4 X |
| 4,905,776 | 3/1990 | Beynet et al. | 175/320 X |
| 4,982,802 | 1/1991 | Warren et al. | 175/408 X |
| 5,090,492 | 2/1992 | Keith | 175/426 X |
| 5,402,856 | 4/1995 | Warren et al. | 175/408 X |

*Primary Examiner*—William P. Neuder
*Attorney, Agent, or Firm*—Browning Bushman

[57] ABSTRACT

A pair of stabilizers are placed in a string of drill pipe having a drill bit or a coring bit at its lower end, the placement of the stabilizers being such that the distance (d1) between the midpoint (mean transverse section) of the gauge surface of the bit and the midpoint (mean transverse section) of such first stabilizer bears a relationship to the distance (d2) between the midpoints of the two stabilizers. The ratio of d1 to d2 (d1/d2) should be between 1/1.5 to 1/5, and preferably between 1/2 and 1/3, with d1 being maintained less than five feet, preferably less than three feet. In one embodiment, the drill bit and the two stabilizers are formed in a monoblock.

6 Claims, 4 Drawing Sheets

METHOD AND APPARATUS FOR REDUCING THE VIBRATION AND WHIRLING OF DRILL BITS AND THE BOTTOM HOLE ASSEMBLY IN DRILLING USED TO DRILL OIL AND GAS WELLS

BACKGROUND OF THE INVENTION

The present invention relates, generally, to a new and improved method and apparatus for reducing the whirl of a drill bit, and/or the whirl of the Bottom Hole Assembly (BHA) in a drillstring used to drill oil and gas wells.

Roller cone bits have been associated with axial vibrations since the first downhole measurements of forces and accelerations were first published. Measurements made while drilling with 3-cone bits have consistently and historically displayed axial vibrations at a frequency of 3 times the rotary speed, and when vibrations were severe the bit was observed to bounce. Cores have suggested that the vibrations are generated by a cammed bottom hole pattern, but it has not been determined whether this is the cause of the vibrations, or merely an effect.

The vibrations associated with PDC bits are somewhat different than those of roller cone bits. Stick-slip torsional vibration of the drill string may be generated by dull PDC bits. PDC bits also vibrate laterally due to backward whirl. When this happens, the bit instantaneously rotates about some point other than the center of the borehole, and the point itself travels in a counter-clockwise direction around the borehole. Backward whirl has been identified as a primary contributor to the damage of PDC cutters, and simulation results suggest that its effects are amplified by torsional oscillations. Ways to mitigate this behavior have been investigated, and the most effective technique has become the basis for a popular commercial product line of PDC bits (anti-whirl bits), for example, as discussed in the SPE Paper No. 24614 entitled "*Directional and Stability Characteristics of Anti-Whirl Bits With Non-Axisymmetric Loading*", presented at the Annual Technical Conference and Exhibition, Washington, DC, Oct. 4–7, 1992, by Pastusek, P. E., Cooley, C. H., Sinor, L. A. and Anderson, M.

Vibrations generated by the bit combine with those due to other sources, such as mass imbalance and wellbore friction, during drilling and reaming operations. The results are axial, lateral, and torsional vibrations of the drill string, which are believed to be a fundamental cause of drill string failures. Mathematical models have been developed by those in the art to identify and avoid operating parameters which lead to damaging downhole behaviors, but the complexity of the downhole environment limits the accuracy of model predictions.

In recent years modelling efforts have given way to monitoring efforts, as surface and downhole measurements have been used to identify harmful operating conditions. When sensors indicate that vibration levels have exceeded some safe level, the weight on bit and/or rotary speed are adjusted. If adjustments are not effective, and component failures are imminent, then the drill string must be pulled and its design modified.

The primary object of the present invention is to provide new and improved methods and apparatus for reducing the vibrations and whirling of drill bits and/or the Bottom Hole Assembly located on the lower end of the drillstrings used to drill oil and gas wells.

SUMMARY OF THE INVENTION

The objects of the invention are accomplished, in general, by the placement of first and second stabilizers in the drillstring at preselected locations above the drill bit, such placement calling for a given first distance between the drill bit and a first stabilizer and for a given second distance between the first stabilizer and a second stabilizer, and for the given first distance and the given second distance to relate to each other in a range of ratios between 1/1.5 and 1/5.

In one embodiment of the invention, the two stabilizers are constructed within a rigid monoblock assembly.

DESCRIPTION OF THE PREFERRED EMBODIMENT

Figure 1:
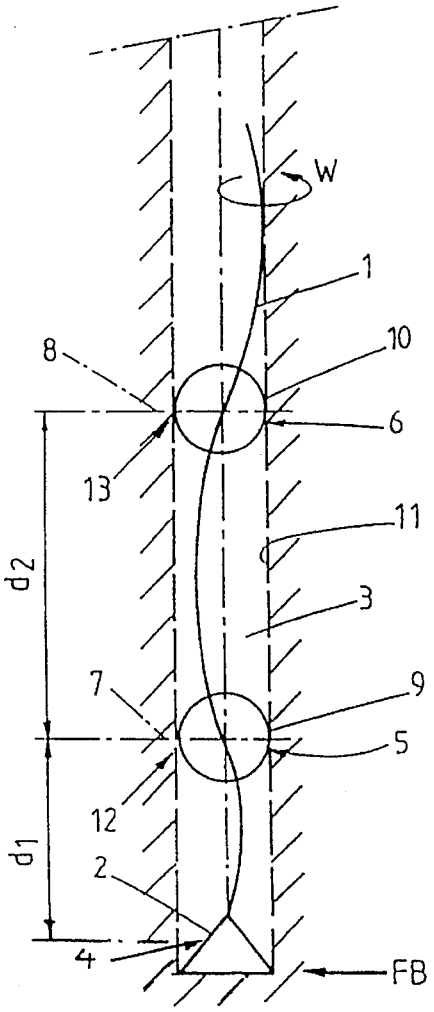
FIG. 1 schematically illustrates a drillstring having placed therein a pair of stabilizers above the drill bit in accord with the invention.

Referring now to the drawings in more detail, FIG. 1 schematically illustrates a drillstring 1 having a drill bit (or coring bit) 2 at its lower end, in an earth borehole 3. The drillstring 1 is schematically illustrated as being deformed along its length, with the deformation wave travelling along the length of drillstring substantially without obstruction between the stabilizer 5 and the stabilizer 6, and from them down to the bit 2 where the deformation wave generates harmful lateral vibrations. By placing the stabilizers 5 and 6 at preselected distances from each other, taking into consideration the distance between the bit 2 and the first stabilizer 5, in accord with the present invention, there is provided a solution to the schematically illustrated deformation wave transmission.

The first distance between the midpoint (the mean transverse section) 4 of the gauge surface of bit 2 and the midpoint (the mean transverse section) 7 of the first stabilizer 5 is first determined (d1). The second distance between the midpoint 7 of stabilizer 5 and the midpoint (the mean transverse section) 8 of stabilizer 6 is then determined (d2). The preferred embodiment contemplates that the ratio of d1 to d2 (i.e. d1/d2) should be in a range of 1/1.5–1/5. Even more preferred, the ratio of d1 to d2 should be between 1/2 and 1/3.0 in order to reduce the lateral force to near zero for an otherwise whirling bit during the drilling operation.

In FIG. 1, the two stabilizers 5 and 6 are schematically illustrated as spheres so as to be in accordance with the deformation amplified along the drillstring 1. Quite obviously, drillstring stabilizers topicals have forms other than those of spheres, as will be explained in more detail hereinafter.

If desired, the first stabilizer 5 can be formed integrally with the drill bit 2 so as to increase stabilizing bearing effect of the stabilizer 5 on the drill bit 2, and in particular, upon the midpoint 4 of the bit 2 provided with known cutting elements.

Figure 2:
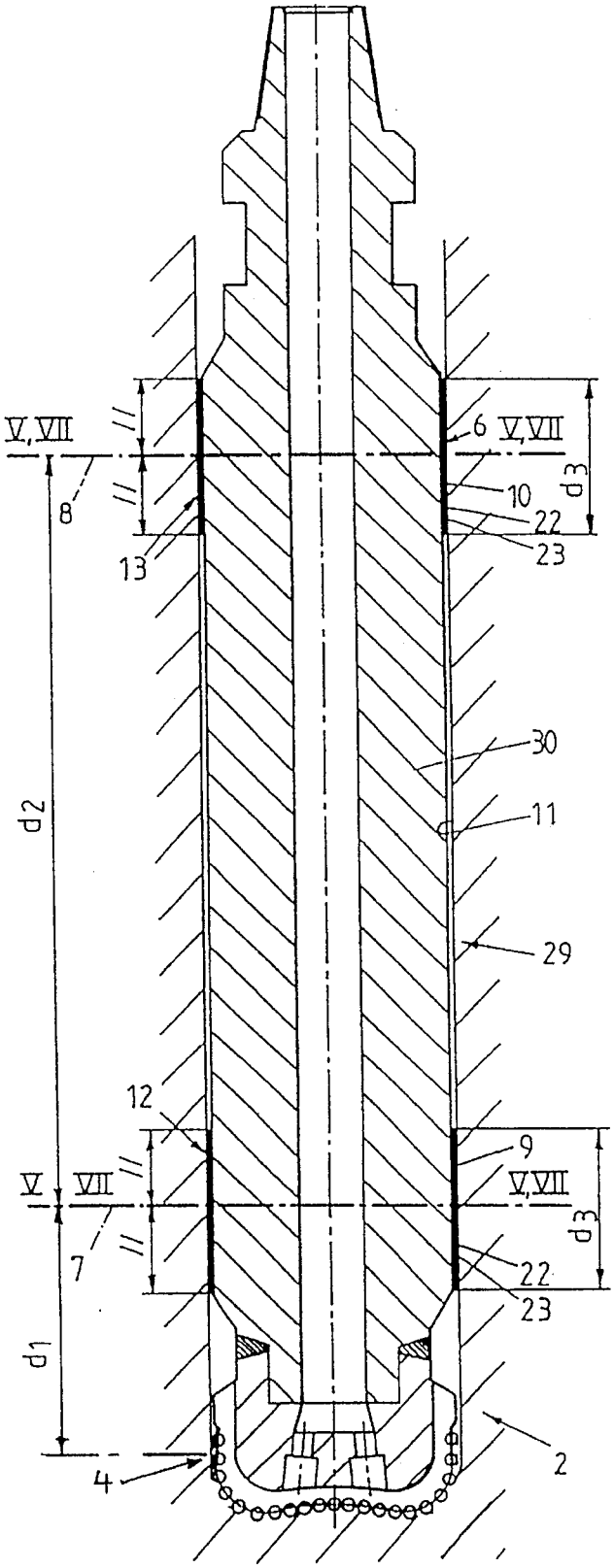
FIG. 2 is a sectional, elevated view of a rigid monoblock assembly having a pair of spaced stabilizers in accord with the invention.

The rigid connection formed between the stabilizers 5 and 6, illustrated in FIG. 2, and between the stabilizer 5 and the drill bit 2, can be constructed in accord with the threaded joint illustrated and described in Belgium Patent No. BE-B 10 1000526A3 filed on May 12, 1987. If an integral device is preferred, the monoblock assembly illustrated in FIG. 2 can be used, eliminating the threaded connections between the stabilizers 5 and 6 and between the lower stabilizer 5 and the drill bit 2.

In FIG. 2, the two stabilizing zones 5 and 6 comprise stabilizers 9 and 10, respectively. The individual stabilizing element 9 and 10 are themselves well known in the art, and have the ability to contact the walls 11 of the borehole 3. The stabilizers 9 and 10 contact the locations 12 and 13, respectively, of the borehole wall 11. The distance d1 between the midpoint (the mean transverse section) 4 of the gauge surface of bit 2 (core bit or drill bit as desired) and the section 7 transverse to the longitudinal axis of the drillstring 1 (the midpoint of location 12) and the distance d2 between the transverse section 8 (located at the midpoint of location 13) are also determined to meet the criteria that d1/d2 is in the range of 1/1.5–1/5, and more preferably, in the range of 1.2–1/3.0.

According to one embodiment of the invention, the stabilizer 5 (or 11 as the case may be) nearest the bit 2 is carried by the bit 2 in order to keep the bit 2 as closely as possible in line with the borehole 3 being drilled.

Figure 4:
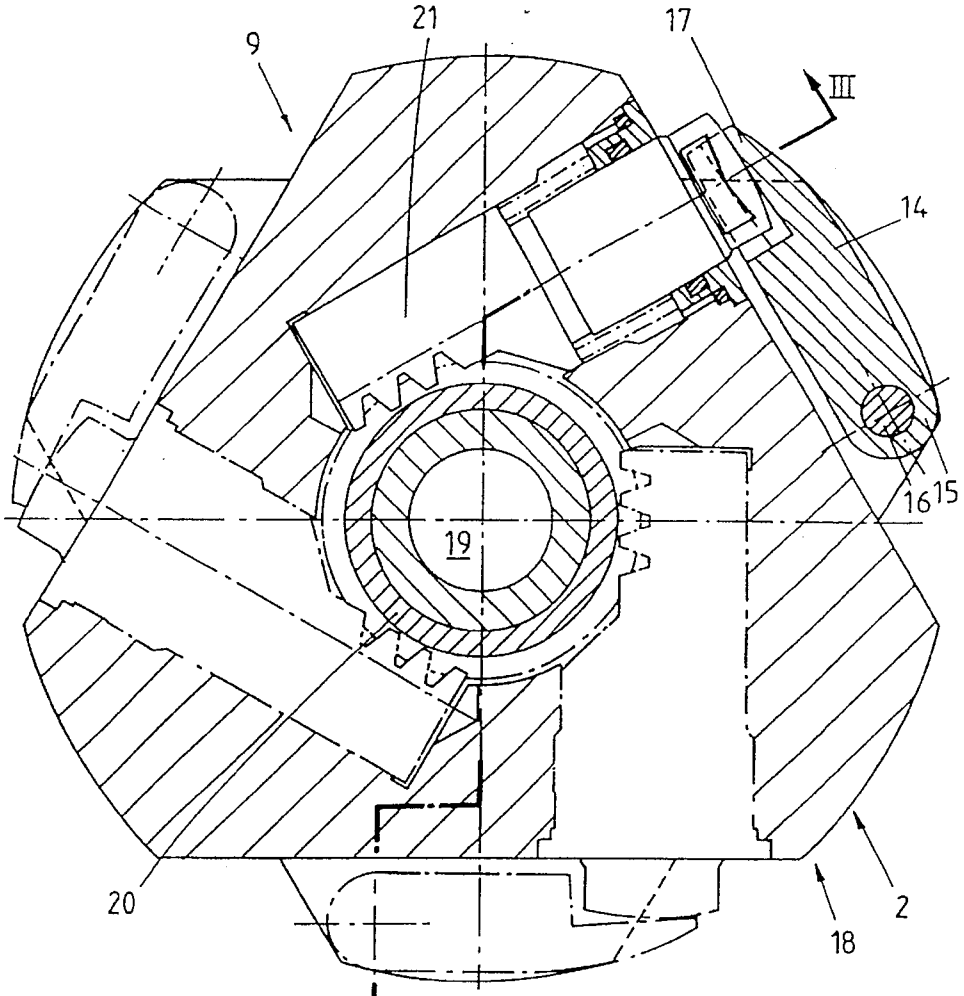
FIG. 4 is a cross-sectional view taken along line IV—IV through the prior art stabilizer according to FIG. 3.
Figure 3:
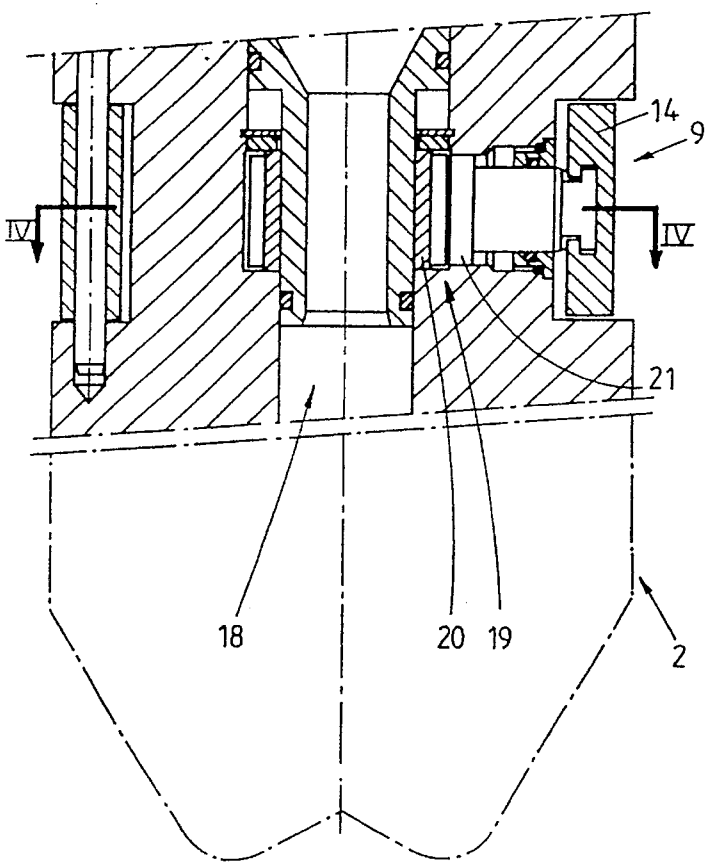
FIG. 3 is a sectional, elevated view of a single prior art stabilizer having utility according to the invention.

In FIGS. 3 and 4, the stabilizer 9 carried by the bit 2 includes moveable arms 14 arranged so as to be distributed evenly around the circumference of the borehole 3 (as determined by the circumference of the drill bit 2) and are actuated, for example, by the control system described in Belgium Patent Application No. BE-A09201068, filed on Dec. 4, 1992. The arms 14, coated with a known antiwear material in the areas thereof destined to contact the borehole wall, includes an extremity 15 pivoted around an axis 16 parallel to the longitudinal axis of the drillstring 1, the other extremity 17 of each arm 14 being free.

The extremity 17 may be situated upstream the pivot axis 16 when considering the rotational direction of the bit 2 during the drilling operation. Control means 18 are provided for bringing the arms 14 into two extreme positions, a first so-called neutral position wherein the arm 14 is housed within an imaginary cylinder of the same diameter as the nominal diameter of the bit 2, and coaxial to the bit 2, and a second operation position wherein the free extremity 17 projects out with respect to the bit 2. Synchronization means 19, in the form of a pinion 20 and racks 21 being arranged for cooperating with control means 18 to displace between the two extreme positions, substantially simultaneously, in the same direction with the same applied force.

Alternatively, the stabilizer 10 may have movable arms 14, regardless of whether stabilizer 9 has movable arms 14.

Figure 5:
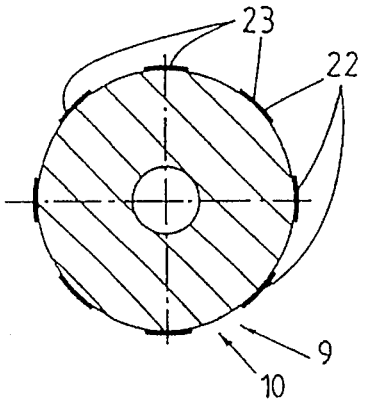
FIG. 5 is a cross-sectional view along either of the lines V—V taken through one of the two stabilizers illustrated in FIG. 2.

Instead of the above movable arms 14, other means may be used as stabilizer means 9 and/or 10, for example, those means which are described in Belgium Patent No. BE-A09200600 filed on Jun. 26, 1992. According to the invention, the stabilizer means 9 and/or 10 (FIGS. 2 and 5) may advantageously include fixed elements 22 which are known per se and which are regularly distributed over the circumference of the corresponding stabilizing zone 5 and/or 6 such that the active face 23 on the periphery of each fixed element 22 is situated on a cylinder, the diameter of which is substantially equal to the diameter of the drill bit 2. Preferably, these fixed elements 22 are made of a known antiwear material or are coated with this material.

Figure 6:
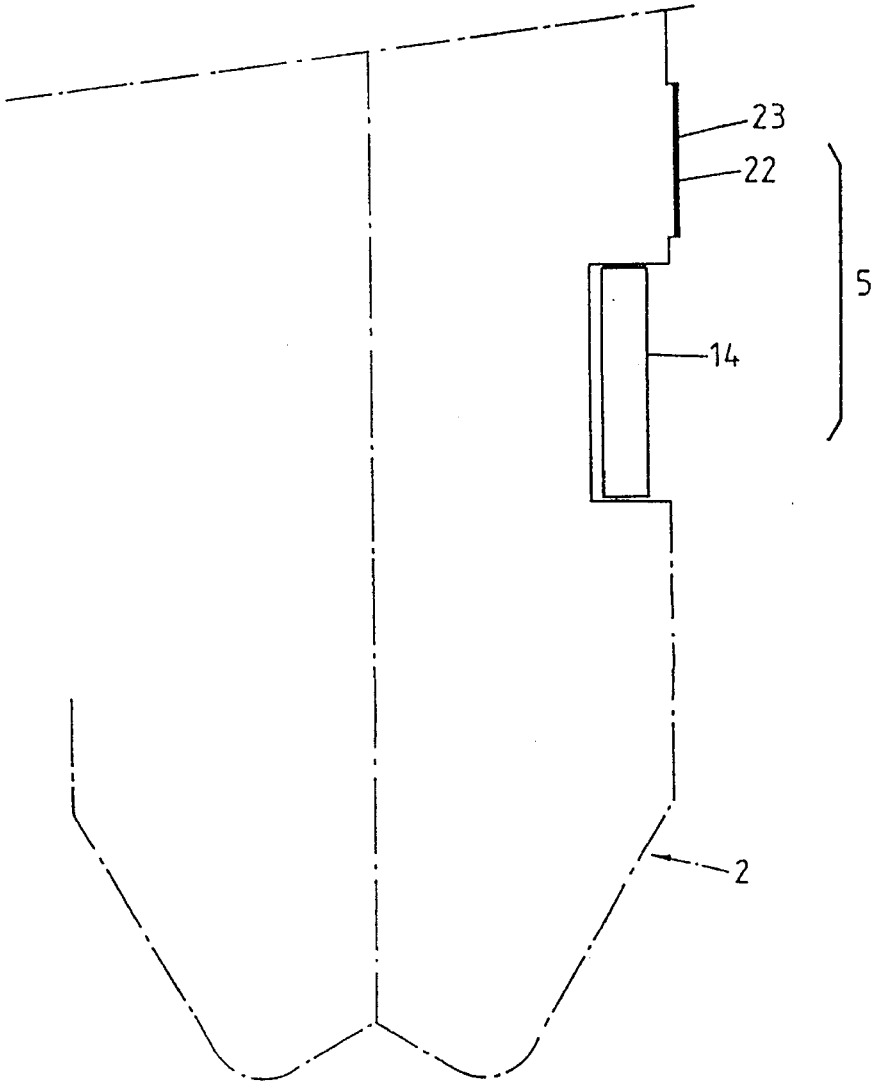
FIG. 6 is an elevated view of the prior art stabilizer of FIG. 3 having a combination of fixed elements and movable arms.

It may be appropriate to provide one or both of said stabilizing zones 5, 6 with a combination of movable arms 14 and fixed elements 22, for example by dividing (FIG. 6) the concerned stabilizing zone 5 (or 6) in a peripheral zone with movable arms 14 which are regularly distributed over its circumference and, adjacent to this zone, a peripheral zone with fixed elements 22 also being regularly distributed over its circumference. In this case, the fixed elements 22 can be used commonly whereas the movable arms 14 can for example, only be applied in the event of establishing that the lateral force is higher than a predetermined threshold.

Figure 7:
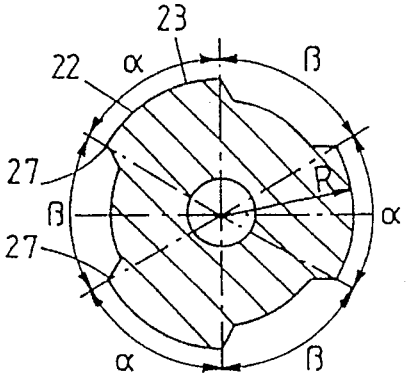
FIG. 7 is a cross sectional view along either one of the lines VII—VII taken through one of the two stabilizers in the monoblock assembly of FIG. 2, but having alternative forms of fixed elements for stabilization.
Figure 8:
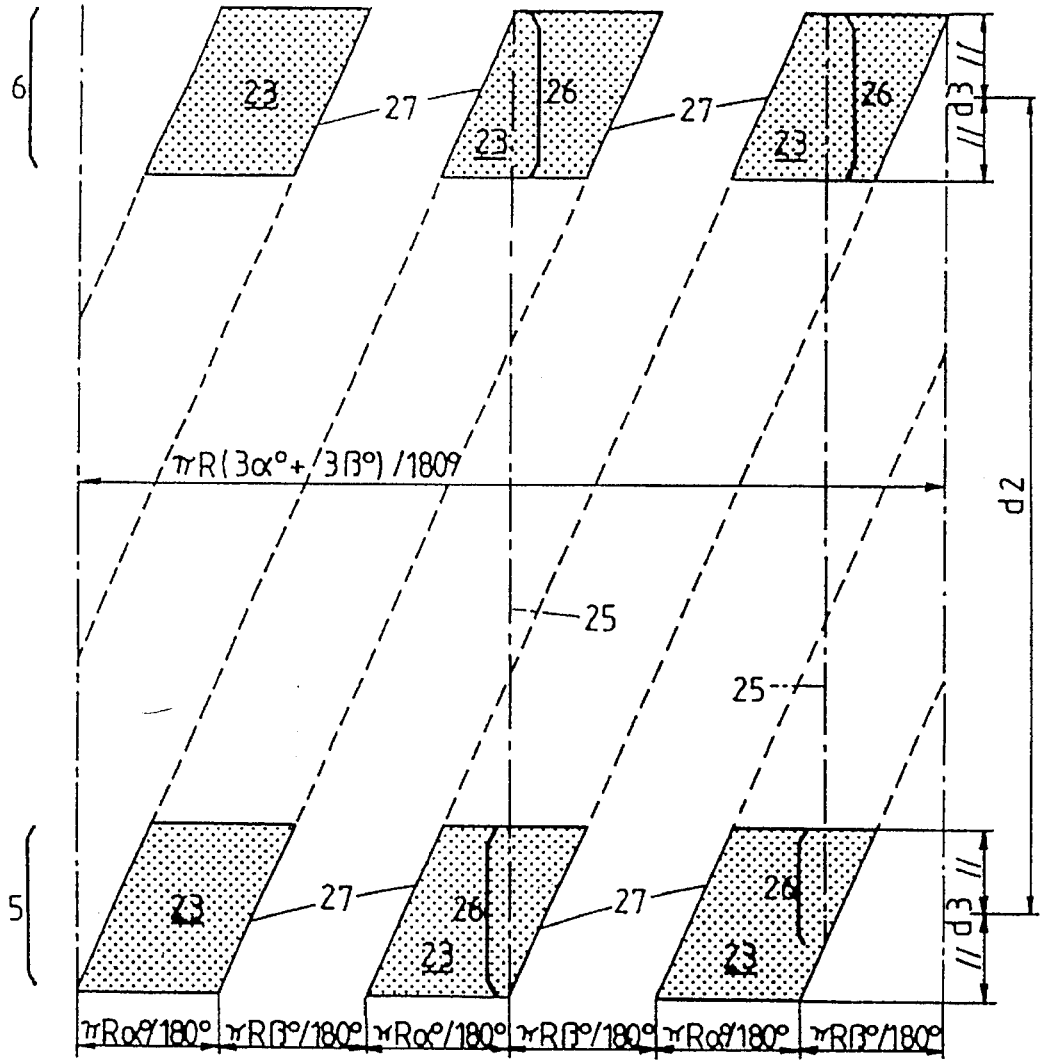
FIG. 8 graphically illustrates, in flat expansion, a cylindrical surface passing along the active faces of the fixed stabilizer elements of FIG. 7.

The fixed stabilizer elements 22 (FIGS. 2, 7 and 8) may be distributed over the circumference of the two stabilizing zones 5 and 6 such that their active faces 23 are arranged onto a theoretical cylindrical surface which coincides substantially with the wall 11 of the borehole 3 and such that the entirety of these active faces 23 has at least one contact point with every generatrix 25 of this theoretical cylindrical surface. The expansion of this theoretical cylindrical surface with radius R, shown in FIG. 8, allows one to see on the generatixes 25 portions 26 formed by the points of contact with the screened surfaces representing the active faces 23. The oblique arrangement of the lateral edges 27 of these active faces 23, as shown in FIG. 8 for three active faces 23 per stabilizing zone 5,6, insures this contact point arrangement for every generatrix 25. When two edges 27 of a same active face 23 are on an angular distance $\alpha$ and two adjoining edges 27 of two adjacent active faces 23 are on an angular distance $\beta$, the corresponding arc length on the expanded theoretical cylinder is respectively $$\frac{\pi R\alpha^\circ}{180^\circ} \text{ and } \frac{\pi R\beta^\circ}{180^\circ}$$

In a similar way, arranging more active faces 23 of a shorter arc length according to the angles $\alpha$ and $\beta$ in a stabilizing zone 5,6 permits to occur in this zone itself the condition as to at least one contact point of the fixed elements 22 with every generatrix 25 of the theoretical cylindrical surface coinciding with the wall 11.

Of course, this condition of contact point with each generatrix 25 can also be met in the case of movable arms 14 in their so-called operative position as well as in the case of a combination of movable arms 14 and fixed elements 22.

A preferred embodiment of the apparatus according to the invention is obtained by joining (FIG. 2) in a rigid monoblock assembly 29 the drill bit 2 and the stabilizer means 9 and 10 of the respective zones 5 and 6, the stabilizer means being fixed elements 22 and/or movable arms 14. As shown by the same FIG. 2, the actual drill bit 2 can be welded to the body 30 carrying the stabilizer means 9,10. By machining the monoblock assembly 29 after having welded the bit 2 enables one to obtain an important coaxiality precision of the different constituent elements of this monoblock assembly 29 according to FIG. 2.

In the case of the monoblock assembly 29, it may be preferred that the immediately adjacent portion of the drillstring 1 is relatively less rigid so that the monoblock assembly 29 may guide itself, through its stabilizer means 9 and 10 in the borehole 3 during the drilling, without being forced laterally by the whirling of the drillstring 1.

As an alternative embodiment, one which is equally preferred, the first and second stabilizers are not formed in a monoblock assembly, but rather are threaded together in the conventional manner, with or without a sub or another section of drill pipe or drill collar between the two stabilizers.

As previously discussed herein, the parameters d1 and d2 are maintained within a ratio range of approximately 1/1.5 to 1/5, and preferably within the ratio range of 1/2 to 1/3. As important as maintaining those ratio ranges, are the values of d1 itself. With a value for d1 of 1.5 feet measured between the midpoint 4 of the gauge surface of the bit and the midpoint of the near stabilizer 5, the value of d2 should be established as being between 2.5 feet and 7.5 feet. The results were found to be quite excellent in practicing the invention to use a d1 of 1.5 feet and a d2 of 3.0 feet, thus establishing a d1/d2 ratio of 1.5/3 (1/2). With a d1 of 1.5 feet and a d2 of 4.5 feet, there is maintained a d1/d2 ratio of 1.5/4.5 (1/3).

In determining the limits of d1 and d2, d1 should be maintained at approximately 1.5 feet and no greater than five feet, preferably no greater than two to three feet, with d2 then being maintained within the d1/d2 ratios of 1/1.5 to 1/5, and preferably within the ratio range of 1/2 to 1/3.

What is claimed is:

1. A drillstring of drill pipe and drill collars for drilling oil and gas wells, comprising:

a first stabilizer in said drillstring;

a second stabilizer in said drillstring; and a drill bit connected into the lowermost end of said drillstring, said drill bit having a gauge surface, the midpoint (mean transverse section) of said gauge surface being a determined distance d1 from the midpoint (mean transverse section) of said first stabilizer, and said midpoint of said first stabilizer being a determined distance d2 from the midpoint (mean transverse section) of said second stabilizer, wherein d1 is no greater than about five feet, and wherein the ratio of d1 to d2 is in the range of 1/1.5 to 1/5.

2. The drillstring according to claim 1, wherein said drill bit is integral with said first stabilizer.

3. The drillstring according to claim 1, wherein said drill bit is threadedly connected to said first stabilizer.

4. The drillstring according to claim 1 wherein said first and second stabilizers are formed within a monoblock.

5. The drillstring according to claim 1, wherein the first and second stabilizers and the drill bit are formed within a monoblock.

6. The drillstring according to claim 1, wherein the ratio of d1 to d2 falls within the range of 1/2 and 1/3.

* * * * *